US009540571B2

(12) United States Patent
Norling

(10) Patent No.: US 9,540,571 B2
(45) Date of Patent: Jan. 10, 2017

(54) IN-LINE SYSTEM FOR DE-SALTING DIESEL OIL SUPPLIED TO GAS TURBINE ENGINES

(75) Inventor: Rasmus Norling, Fort Lauderdale, FL (US)

(73) Assignee: Triton Emission Solutions Inc., San Juan, PR (US)

( * ) Notice: Subject to any disclaimer, the term of this patent is extended or adjusted under 35 U.S.C. 154(b) by 314 days.

(21) Appl. No.: 12/779,385

(22) Filed: May 13, 2010

(65) Prior Publication Data

US 2010/0276340 A1 Nov. 4, 2010

Related U.S. Application Data

(63) Continuation of application No. PCT/US2008/083713, filed on Nov. 16, 2008.

(60) Provisional application No. 60/996,430, filed on Nov. 16, 2007.

(51) Int. Cl.
*C10G 31/08* (2006.01)
*C10G 21/08* (2006.01)

(52) U.S. Cl.
CPC ..... *C10G 21/08* (2013.01); *C10G 2300/1055* (2013.01); *C10G 2300/201* (2013.01)

(58) Field of Classification Search
USPC ..... 208/187
See application file for complete search history.

(56) References Cited

U.S. PATENT DOCUMENTS

| | | | | |
|---|---|---|---|---|
| 1,924,038 | A | | 8/1933 | Herbsman et al. |
| 2,698,303 | A | | 12/1954 | Blair, Jr. et al. |
| 3,119,704 | A | | 1/1964 | Harrell et al. |
| 3,190,618 | A | | 6/1965 | Katzen |
| 4,175,873 | A | * | 11/1979 | Iwako et al. ..... 366/165.3 |
| 4,206,817 | A | | 6/1980 | Bowerman |
| 4,348,288 | A | * | 9/1982 | Yoshinaga et al. ..... 208/15 |
| 4,361,285 | A | * | 11/1982 | Koppehele et al. ..... 239/424 |
| 4,487,510 | A | | 12/1984 | Buurman et al. |
| 4,728,416 | A | * | 3/1988 | Myers ..... 208/120.2 |
| 4,909,635 | A | | 3/1990 | Locoffre et al. |
| 4,981,368 | A | | 1/1991 | Smith |
| 5,228,283 | A | | 7/1993 | Sciocchetti |
| 5,967,658 | A | | 10/1999 | Mohajer |
| 6,811,302 | B2 | | 11/2004 | Fleischli et al. |
| 6,814,481 | B2 | | 11/2004 | Columbo |
| 7,137,371 | B2 | | 11/2006 | Simpson et al. |
| 2006/0245296 | A1 | | 11/2006 | Nishioka et al. |

FOREIGN PATENT DOCUMENTS

| | | |
|---|---|---|
| EP | 0 188 119 A1 | 7/1986 |
| FR | 2 388 037 | 11/1978 |
| GB | 705267 | 3/1954 |
| GB | 722729 | 1/1955 |
| GB | 2 271 725 A | 4/1994 |
| WO | WO 2006/003525 A1 | 1/2006 |

OTHER PUBLICATIONS

Supplementary Search Report in Counterpart European Appln. No. 08 85 0493.1 dated Sep. 26, 2012.

* cited by examiner

*Primary Examiner* — Michelle Stein
(74) *Attorney, Agent, or Firm* — Seed IP Law Group LLP

(57) ABSTRACT

An in-line system uses a simple static emulsifier to thoroughly mix salt-containing fuel oil with water, thereby to draw the salt from the fuel oil into the water preferentially, and then the de-salted fuel oil is separated from the salt-containing water.

10 Claims, 7 Drawing Sheets

WATER NOZZLE

MIXING PINS FOR CREATING TURBULENT FLOW

MIXING PINS FOR CREATING TURBULENT FLOW

VANES FOR CREATING TURBULENT FLOW

BIO SCRUBBER WITH 3 NOZZLES

IN-LINE SYSTEM FOR DE-SALTING DIESEL OIL SUPPLIED TO GAS TURBINE ENGINES

CROSS REFERENCE TO RELATED APPLICATIONS

This application is a continuation of International Patent Application No. PCT/US2008/083713 filed Nov. 16, 2008, which is based on and claims the benefit under 35 U.S.C. §119 to provisional application No. 60/996,430 filed Nov. 16, 2007, incorporated herein by reference.

BACKGROUND OF THE INVENTION

This invention is concerned with a simple, low-cost system for de-salting fuel oil, particularly biodiesel, supplied to gas turbine engines, particularly marine gas turbine engines of the type used in propulsion systems for ships.

In response to rising costs and environmental concerns associated with traditional fossil fuels, fuel-dependent industries are turning to biodiesel to power gas turbine engines. In the implementation of a biodiesel program, it became apparent that salinity found in biodiesel is a significant problem. Salinity reduces the lifespan of gas turbine engines. The normal lifespan of a gas turbine engine burning fuel with an optimal level of salinity of less than 0.1 ppm is 25,000 hours. When the salinity is increased to 0.2 ppm, the maximum concentration for commercial use, the lifespan is reduced by 50%, and at 0.7 ppm there is a 90% reduction in lifespan.

Early in the program of using biodiesel to power marine gas turbine engines, it was discovered that the salinity level of fuel intended for use was in the range of 5-11.5 ppm, which is unacceptable. Such high salinity content renders the fuel unsuitable for use by gas turbine engines.

While processes exist in the prior art for de-salting fuel oil, they are expensive and impractical for use in de-salting fuel to power marine gas turbine engines. Such engines burning 100% biodiesel (a 99.9% biodiesel, 0.1% palm oil blend mix) require an optimal level of salinity of less than 0.1 ppm. The present invention provides a biodiesel fuel having the required characteristics.

BRIEF DESCRIPTION OF THE INVENTION

The present invention provides a method and an apparatus for de-salting fuel oil, particularly fuel oil used to power marine gas turbine engines. The invention uses an in-line section of pipe of predetermined length that is part of a piping system for supplying de-salted fuel to a gas turbine. Salt-containing fuel oil and water are supplied to the section of pipe in such a manner that a water-fuel oil emulsion is created in the section of pipe and such that the water extracts salt from the salt-containing fuel. De-salted fuel and salt-containing water are passed to a separator, more particularly a centrifugal separator. The construction of the section of pipe is such that turbulent flow is created therein. The water is injected into the section of pipe as a fine spray, using a nozzle, more particularly a sprinkler head. The construction of the section of pipe is such that the salt-containing fuel oil is caused to swirl before it encounters the fine spray of water injected into the section of pipe. Mixing pins in the section of pipe promote turbulent flow in the emulsion passed from the section of pipe to the separator.

BRIEF DESCRIPTION OF THE DRAWINGS

The invention will be further described in conjunction with the accompanying drawings, which illustrate preferred (best mode) embodiments, and wherein.

DETAILED DESCRIPTION OF THE INVENTION

The present invention is an in-line system using a simple static emulsifier to thoroughly mix salt-containing fuel oil (e.g., biodiesel) with water, thereby to draw the salt from the fuel into the water preferentially, and then separating the de-salted fuel from the salt-containing water. This process can be carried out repeatedly in a closed cycle until the desired salinity level is attained.

Figure 1:
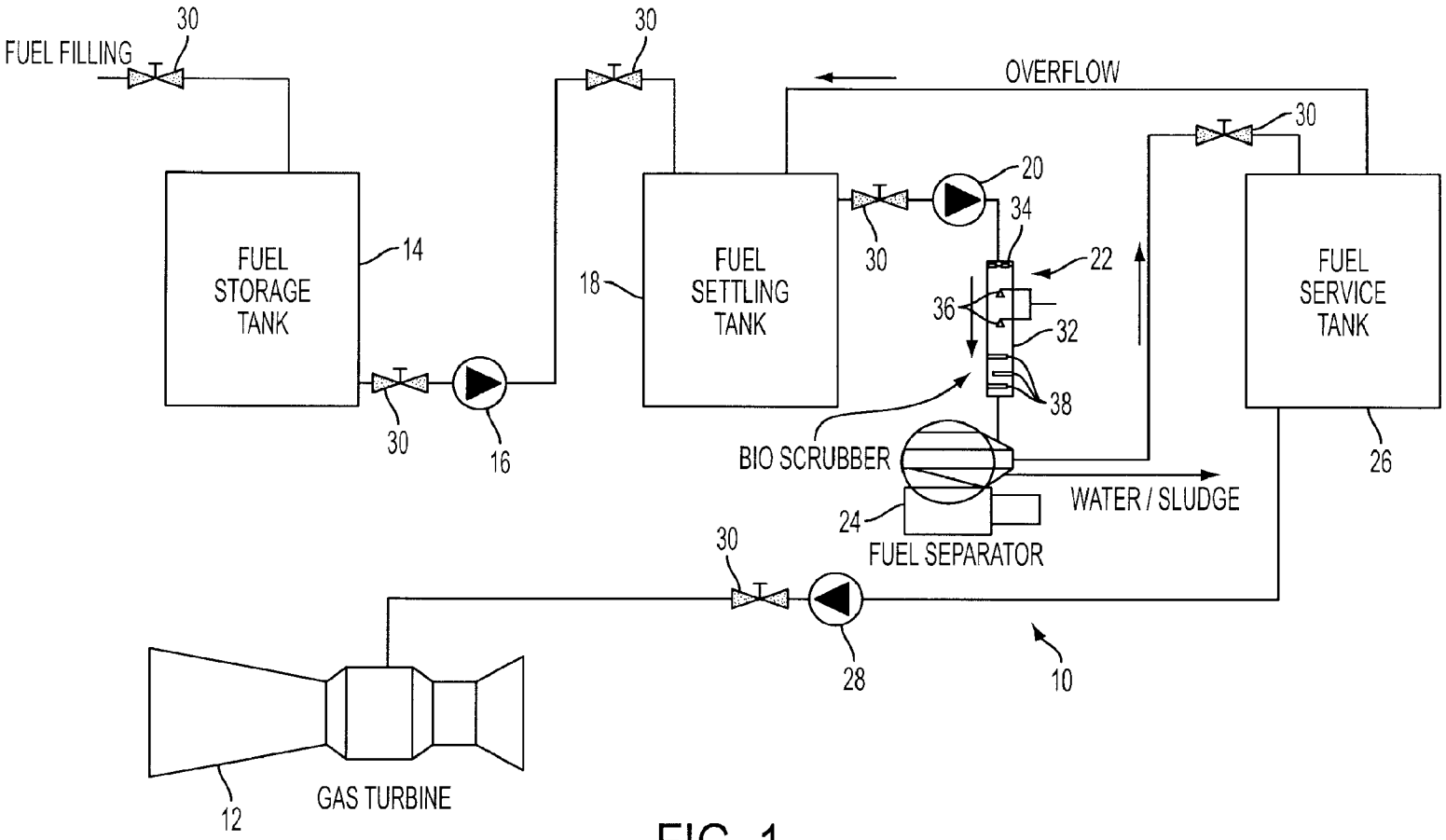
FIG. 1 is a diagrammatic view of a fuel-supply system according to the invention.

FIG. 1 shows, diagrammatically, a fuel-supply system 10 according to the invention, for supplying de-salted biodiesel to a gas turbine engine 12. Fuel is supplied to the fuel storage tank 14 from an on-shore fuel facility. The fuel is then pumped by a pump 16, based on consumption, to the fuel settling tank 18. From the fuel settling tank, fuel is pumped by a pump 20 through a static emulsifier 22 (bio scrubber), in which the fuel is thoroughly mixed with water, and then to a centrifugal fuel separator 24. The separator separates the emulsion into two components, namely, an at least partially de-salted fuel, and salt-containing water. The de-salted fuel is supplied to a fuel service tank 26, which overflows back to the fuel settling tank. Once the fuel has been de-salted to the required low salinity level, it can be pumped by a pump 28 to the gas turbine 12. A system of valves 30 shown in FIG. 1 is used to control fuel flow to the various sections of the system. Among other things, this permits repetitive cycling of partially de-salted fuel, through the emulsifier 22 and the separator 24, until the desired salinity level is achieved. The system can operate automatically, or valves 30 can be controlled manually. An ordinary salinity meter can be used to determine the salinity level. The level of fuel in the fuel service tank will depend upon the fuel consumption by the gas turbine.

An essential component of the invention is the static emulsifier 22, which, in the embodiment, is a section of pipe 32 (e.g., 4" diameter) into which fuel is directed by a three-blade "propeller" 34 made of bent flat steel. The propeller (which does not rotate) causes the incoming fuel to swirl as it enters the emulsifier.

Figure 1A:
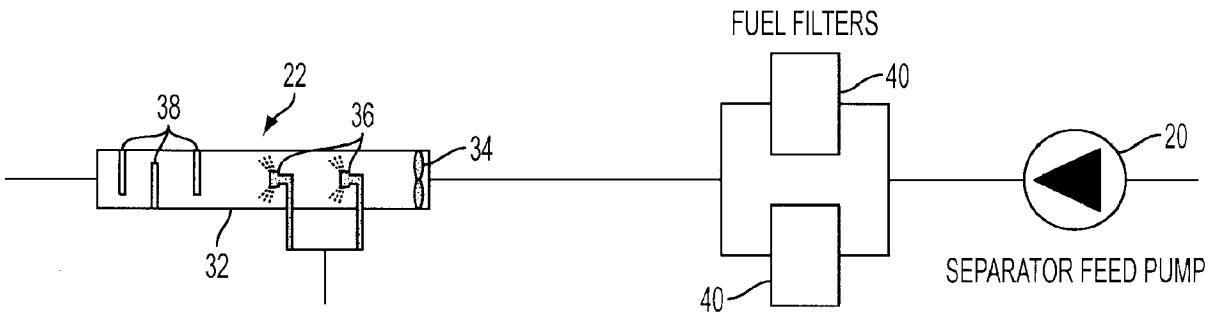
FIG. 1A is a diagrammatic view showing an emulsifier of the invention and related components.

Following the propeller are water-mist nozzles 36, oriented as shown, to which technical (distilled) water from a high pressure washing machine is supplied. The nozzles are sprinkler heads of a type used in fire-control systems aboard ships. The fire control nozzle is designed to give as fine a spray as possible (in order to put out a fire in a compartment). Following the sprinkler heads are a plurality (e.g., three) of mixing pins 38 oriented at different angles across the pipe of the emulsifier to assist in creating turbulent flow that is important to the process of the invention. FIG. 1A shows the emulsifier 22 with the inlet propeller 34, two nozzles 36, and three mixing pins 38. In this figure, a separator feed pump 20 is shown supplying fuel to the emulsifier 22 through fuel filters 40.

Figure 3:
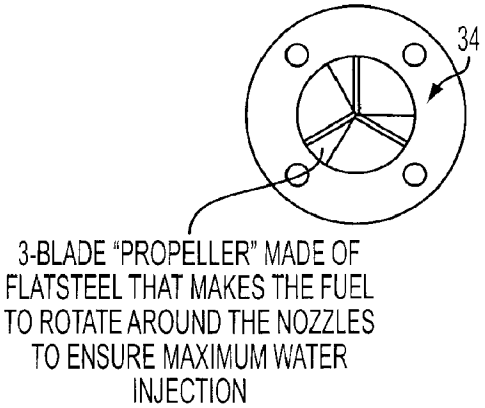
FIG. 3 is a diagrammatic view of a propeller that causes the salt-containing fuel oil to swirl as it enters the emulsifier.
Figure 2:
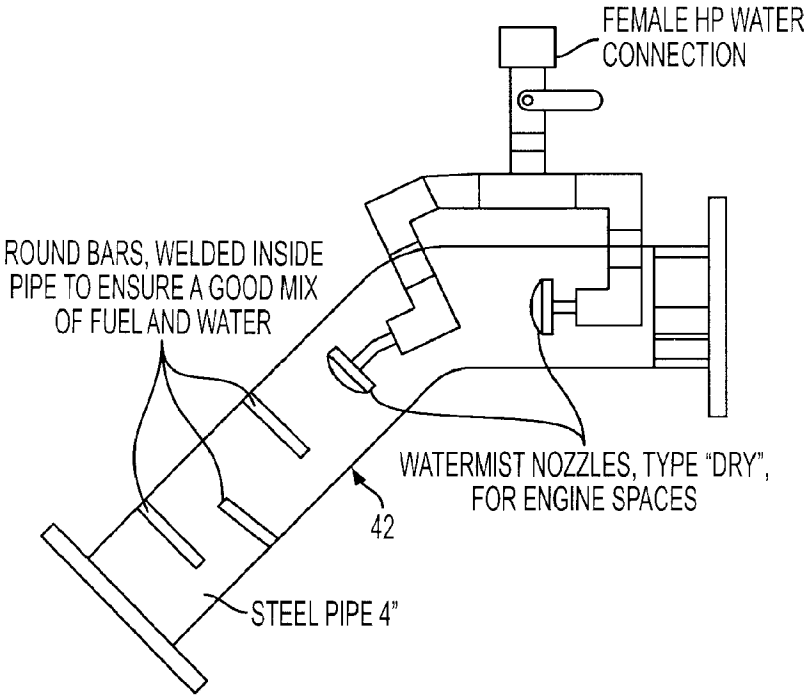
FIG. 2 is a diagrammatic view of a modified emulsifier of the invention.
Figure 4:
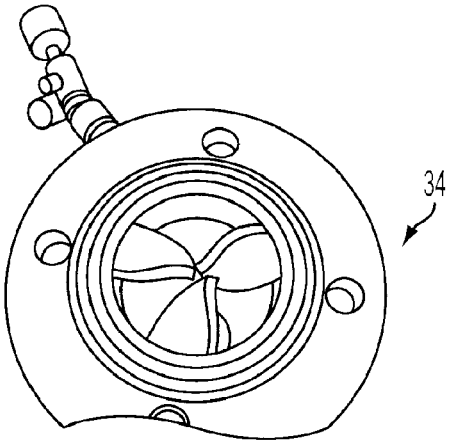
FIG. 4 is a view of an actual propeller used in the invention.
Figure 5:
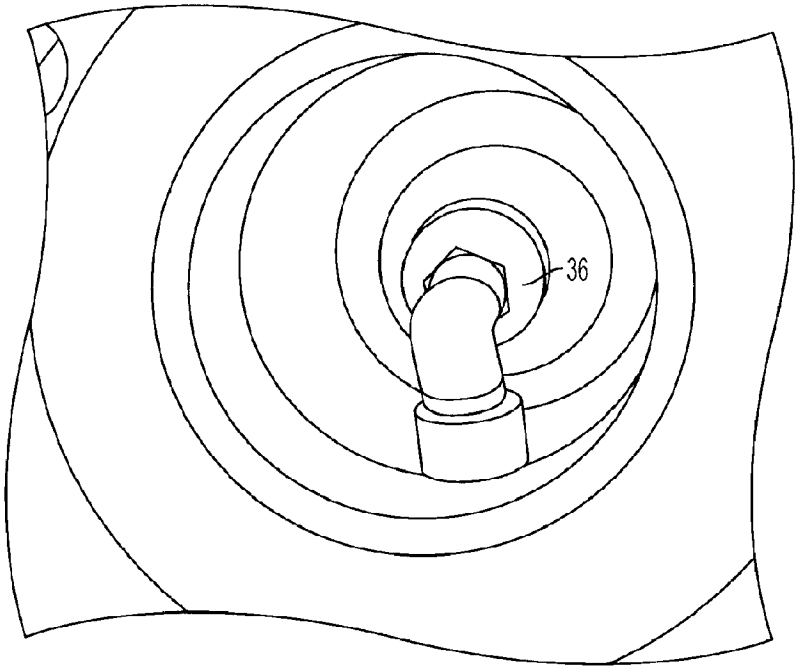
FIG. 5 is a view of an actual water nozzle used in the invention.
Figure 6:
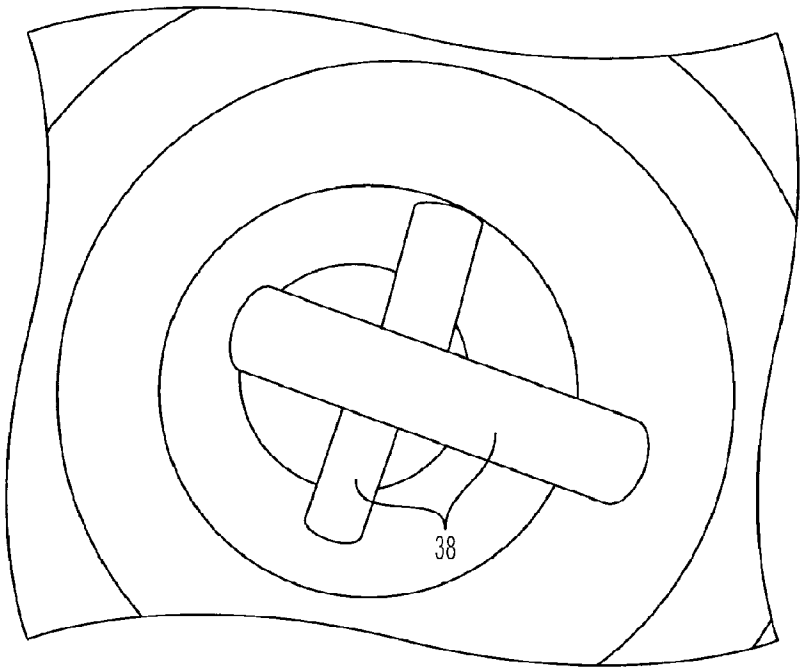
FIG. 6 is a view of actual mixing pins used in the invention.
Figure 8:
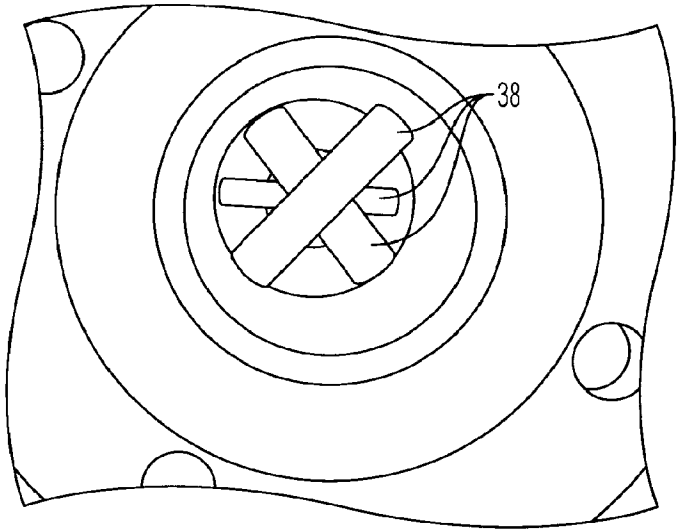
FIG. 8 is another view showing actual mixing pins.
Figure 7:
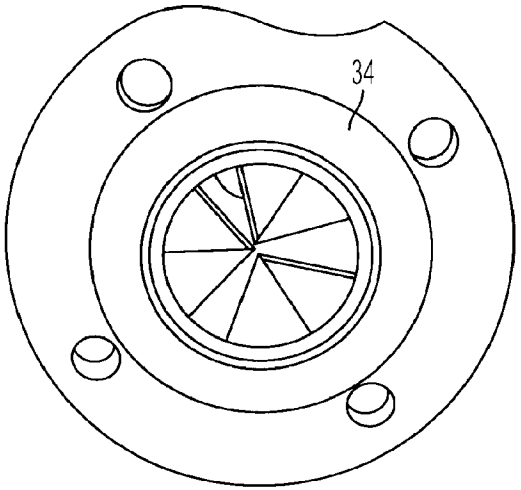
FIG. 7 is a view showing a modified propeller.
Figure 9:
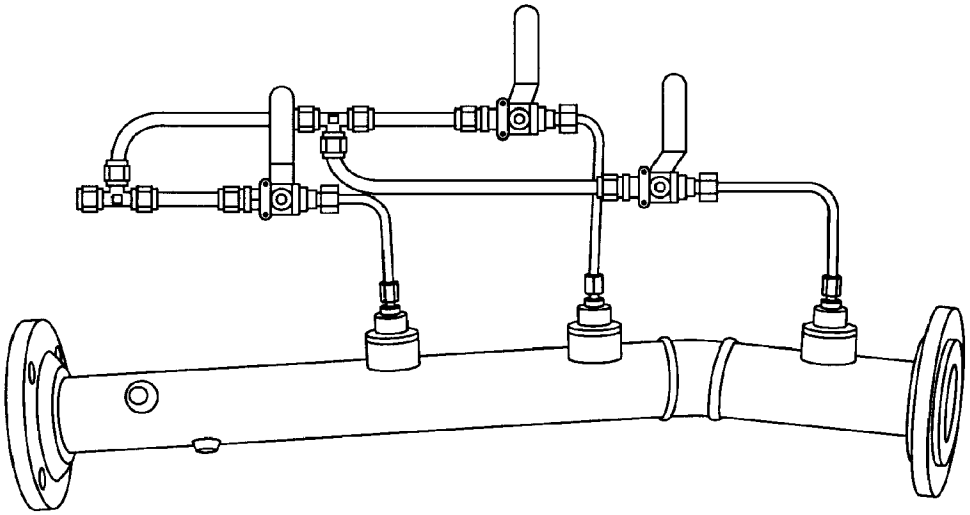
FIG. 9 is a view of another version of an emulsifier employed in the invention.

In the diagram of FIG. 1, the emulsifier 22 is shown as a straight section of pipe 32, but the pipe may be angulated as shown by pipe 42 in FIG. 2. The drawing of FIG. 3 shows a three-blade propeller, while FIG. 4 shows an actual propeller used in the invention. FIGS. 5 and 6 show an actual water nozzle and actual mixing pins. FIGS. 7 and 8 are other views of vanes 34 for creating turbulent flow at the inlet of the emulsifier, and mixing pins for creating turbulent flow. FIG. 9 shows a modification 22 of the emulsifier using three sprinkler head nozzles 36.

In a working embodiment of the invention, water flow was at the rate of 2.4 liters per minute (3.7 $m^3$ over 24 hours) at a water temperature of about 30° C. The temperature of the biodiesel fuel at the point where the water was injected was about 58° C. The use of two fine-spray nozzles together with the swirl-causing propeller and the mixing pins creates an emulsion required to remove salt (e.g., sodium and potassium chloride) from fuel oil supplied at a flow rate of 5 $m^3$/hr, for example.

While preferred embodiments of the invention have been shown and described, it will be apparent that modifications can be made without departing from the principles and spirit of the invention, the scope of which is defined in the following claims.

The invention claimed is:

1. A method of de-salting fuel oil in a fuel supply system of a gas turbine engine, comprising the following steps:

providing a static emulsifier formed of a piece of pipe of predetermined length having a flow path therein along the piece of pipe from a fuel oil inlet at one end of the piece of pipe to an emulsion outlet at the opposite end of the piece of pipe, and having therein, in sequence along the flow path from the inlet to the outlet, a fuel oil-swirl-producer, a water-mist nozzle, and a turbulent-flow-promoter, the static emulsifier being provided as an in-line section of pipe of the fuel supply system;

supplying salt-containing fuel oil to the inlet of the in-line section of pipe before adding water to the fuel oil;

swirling the fuel oil using a propeller using the swirl-producer to cause the fuel oil to swirl and to cause the fuel oil to flow in a turbulent flow region upon entering the in-line section of pipe;

spraying a fine mist of water into the swirling and turbulent flowing fuel oil by supplying water to the water-mist nozzle of the in-line section of pipe and using the nozzle to inject the mist of water in the fuel oil immediately after the fuel oil has been swirled by the swirl-producer to create a fuel oil/water mixture and emulsion, at the same time the water is added, in the in-line section of pipe between the fuel oil-swirl-producer and the turbulent-flow-promoter, to permit the water in the emulsion to extract salt from the salt-containing fuel oil;

turbulently further mixing the oil and water by passing the emulsion to the turbulent-flow-promoter and using the turbulent-flow-promoter to promote turbulent flow in the emulsion in the in-line section of pipe that increases the salt content of the water in the emulsion; and passing the emulsion from the outlet of the in-line section of pipe to a separator in the fuel supply system that separates fuel oil from water that now contains an increased content of salt in the emulsion.

2. A method according to claim 1, wherein the swirl-producer is formed of a static propeller.

3. A method according to claim 1 wherein the water-mist nozzle is formed as a sprinkler head nozzle that creates a fine spray of water.

4. A method according to claim 1 wherein the turbulent-flow-promoter is formed of a group of pins extending across the flow path with different orientations.

5. A method of desalting fuel oil, comprising:

sending salt-containing fuel oil to a static emulsifier before adding water to the fuel oil, the static emulsifier including a static propeller, a mixing nozzle, and mixing pins, in that sequence;

swirling the fuel oil to fill the area of the pipe by passing the salt-containing fuel oil through the static propeller to swirl the salt-containing fuel oil and to cause the fuel oil to flow in a turbulent flow region;

injecting water as a fine spray mist into the swirled and turbulent flowing fuel oil from the mixing nozzle into the swirling salt-containing fuel oil to create a fuel oil and water mixture and emulsion, at the same time, between the fuel oil-swirl-producer and the turbulent-flow-promoter;

passing the fuel oil and water emulsion over the mixing pins to create a continued turbulent flow in the fuel oil and water emulsion to promote the transfer of salt from the fuel oil to the water; and discharging the fuel oil and water emulsion from the static emulsifier into a fuel oil and water separator, the fuel oil and water separator outputting clean fuel oil and salt-containing water.

6. The method of claim 5, wherein the mixing pins are first, second, and third pins, each spanning an interior of the static emulsifier, the first, second, and third mixing pins in first, second, and third planes, respectively, the first, second, and third planes parallel to each other and approximately perpendicular to a direction of flow of the fuel oil, the first pin at a first rotation angle in the first plane, the second pin at a second rotation angle in the second plane, and a third pin at a third rotation angle, none of the first, second, and third rotation angles being equal.

7. The method of claim 5, further comprising:

redirecting the fuel oil and water emulsion in the static emulsifier such that the direction of flow at the static propeller is not equal to the direction of flow at the mixing pins.

8. The method of claim 5, wherein the mixing nozzle is a fire-control system style sprinkler head, the mixing nozzle inducing turbulence in the fuel oil as the fuel swirls around the mixing nozzle.

9. The method of claim 5, further comprising:

injecting additional water as a fine spray mist into the swirled fuel oil and water combination from a second mixing nozzle that is positioned in the flow line after the first mixing nozzle to further increase the water to fuel oil ratio and provide more water to accept additional salt in the fuel oil.

10. The method of claim 5, further comprising:

spraying a second fine mist of water into the swirling fuel oil and water emulsion by supplying additional water to a second water-mist nozzle located in the in-line section of pipe downstream from the first water nozzle and using the second nozzle to inject additional water into the fuel oil/water emulsion after the fuel oil and water have formed an emulsion to provide additional water that can extract additional salt from the salt-containing fuel oil.

* * * * *